US005167404A

United States Patent [19]

Weeks

[11] Patent Number: 5,167,404

[45] Date of Patent: Dec. 1, 1992

[54] MODEL BRIDGE BENT JIG

[76] Inventor: Kenneth R. Weeks, 1650 Pebble Wood Dr., Sacramento, Calif. 95833

[21] Appl. No.: 783,976

[22] Filed: Oct. 29, 1991

[51] Int. Cl.[5] ..... B25B 5/00

[52] U.S. Cl. ..... 269/37; 269/289 R; 269/904

[58] Field of Search ..... 269/37, 40, 41, 43, 269/289 R, 296, 303, 305, 900, 904, 910

[56] References Cited

U.S. PATENT DOCUMENTS 378,457 2/1888 Oakes ..... 269/40
2,331,972 10/1943 Greevy ..... 269/37
4,541,618 9/1985 Bruno ..... 269/41
5,031,886 7/1991 Sosebee ..... 269/41
5,085,414 2/1992 Weaver ..... 269/37

*Primary Examiner*—J. J. Swann
*Attorney, Agent, or Firm*—John P. Halvonik

[57] ABSTRACT

The invention is an indexing jig for building model railroad bridge trestles having a series of horizontal and vertical apertures cut into it to form an interlocking system of grooves for holding the various members that are used to construct trestles including vertical and horizontal members and cross bracing.

5 Claims, 2 Drawing Sheets

MODEL BRIDGE BENT JIG

BACKGROUND OF THE INVENTION

The invention relates to the field of indexing jigs for holding timber components of bridge trestles in position for securing together. More specifically, the jig was conceived as one that would find great use in the model bridge building field so that one could hold the timbers in place so that they may be glued together at their respective angles and relative positions to one another.

The jig provides model railroad hobbyists an easy and efficient way to construct scale model bridge bents, of varying heights, for timber trestle bridges. These bridges make model railroad layouts more realistic and interesting but tend not to be widely utilized by the average model railroader due mainly to the difficulty of constructing the bridge bents which are the integral members of a bridge.

No jig that the applicant is aware of is of similar construction.

SUMMARY OF THE INVENTION

The invention is an indexing jig for model railroad bridge trestles having a series of vertical and perpendicular apertures running substantially the length and width of said jig, the apertures corresponding to the vertical and horizontal cross-members of a railroad trestle and serve to secure these members for a time as the components of the trestle are assembled on said jig. The upper and lower horizontal apertures correspond to the cap and mudsill cross members of a standard railroad bridge.

It is an objective of the invention to provide a jig for holding the various timber components of bridge trestles in position so that they may be secured together in their respective positions.

Another objective of the invention is to provide an indexing jig for holding timber components of model bridge trestles in position so that they may be glued together in their respective positions.

Another objective of the invention is to provide a rail road modeler with a quick, accurate and easy way of accomplishing the creation of trestle bridge.

Other objectives of the invention will become apparent once the invention is shown and described.

DESCRIPTION OF THE PREFERRED EMBODIMENT

The jig comprises a base 4 (preferably of molded plastic) of roughly trapezoidal construction having an upper edge 7 that is somewhat shorter than the bottom edge 8. The jig may, of course, be made of other sturdy materials such as wood, etc. These edges are near to the relative positions of the top most and lower most horizontal cross members in the trestle construction when they are placed in the apertures in the base.

The upper member of the trestle is known as the cap member and rests in the groove shown as 5. The lower most member is known as the mudsill member which can rest in any of the horizontal grooves, e.g. as shown in 9. Note that the upper horizontal member is not flush with the edge, but rather is in position a short ways from the very edge of the base. The lower horizontal member is placed in any one of the several grooves depending on the bent height desired.

Figure 1:
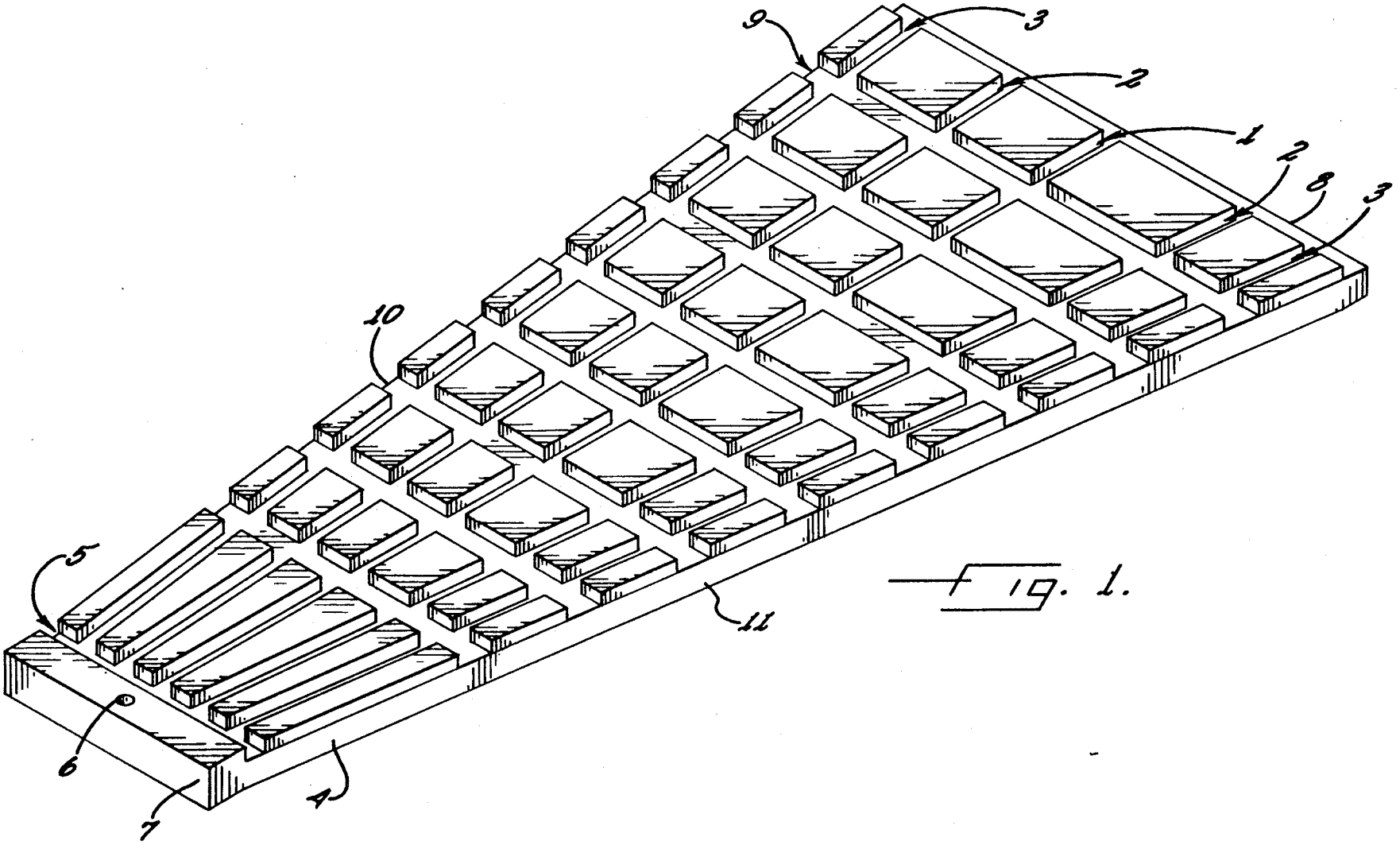
FIG. 1 shows the overall construction of the model bridge jig.
Figure 2:
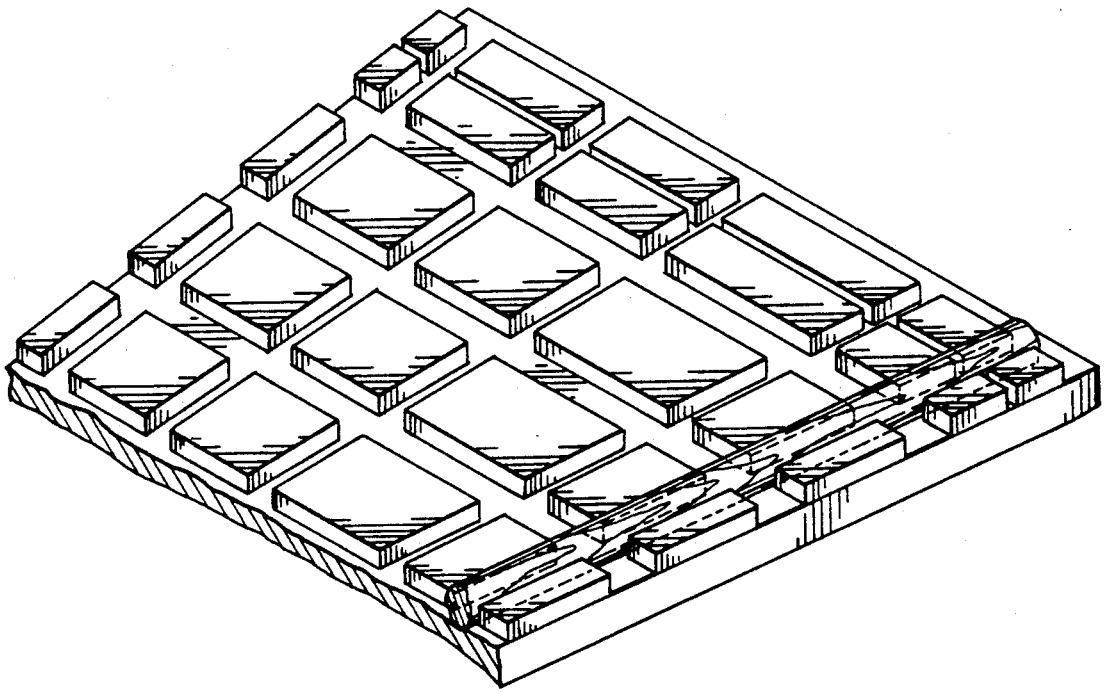
FIG. 2 shows an optional mitre at the bottom of the jig for cutting post ends to correct angle to mate with cap and mud sill.

The side edges 10, 11 of the base are at an angle as shown in FIG. 1 so that they conform to the general direction of the vertical members of the trestle. Thus the overall plan form of the base is of a trapezoid. These vertical members will rest in the grooves shown as 1,2, and 3. Those grooves 2 and 3 are somewhat at an angle, ie.: they are not at a perfectly right angle to the top and bottom edges.

Cut into the base are a series of grooves of square or U shaped cross section and running vertically as 1,2 and 3 and horizontally between 5 and any of the horizontal grooves 9. It is these grooves which hold the individual timbers (members) so that they may be glued (in the case of model railroad bridges) or otherwise secured to each other. The grooves allow the individual members to be secured in the appropriate relation to each other. The grooves are of size sufficient to allow about ½ of the diameter of a member to protrude above the level of the base once a member is secured in the jig.

The jig makes it possible to assemble the components of a bridge bent of various heights from 2" to 10", when modeling in HO scale. It is preferred that the horizontal grooves be spaced about 1" apart. The range of bent heights has been arbitrarily selected and could be longer or shorter. The horizontal apertures which are approximately ½" wide have been incorporated in to the jig to allow the positioning and gluing of horizontal members whose length is a function of each bent's height.

The topmost horizontal member of each bridge bent is known as a cap and fits in groove 5. This is the initial bridge bent component to be installed in the jig for assembly.

The five vertical posts correspond to grooves 1,2, and 3. The vertical members for a given bridge bent height are positioned into their respective grooves in the jig so that they may be indexed and glued to the cap. The jig provides the user the ability to properly locate each of the five vertical posts symmetrically about the center vertical post which corresponds to groove 1. The center post is located at the mid point of the cap and perpendicular to it. The remaining four posts fit in grooves 2 and 3 and are located symmetrically and equidistant about the axis of the center post.

The two inner posts (groove 2) and the two outer posts (groove 3) assume angles of 3.75 degrees and 7.5 degrees respectively, to the axis of the center post such that their ends are closer together where they join the cap and farther apart where they join the mud sill. Once the posts have been secured to the cap the mud sill is glued to the ends of the posts such that the mid point of the mud sill length corresponds to the axis of the center post and is perpendicular to it.

Horizontal and diagonal cross bracing, which gives the bridge bent lateral stability may be applied to one side of he vertical and horizontal members while still in the jig. The placement of the bracing is facilitated by several scribed marks on the jig.

The depth of the grooves is less than the thickness of the members so that after the posts, cap, and mud sill have been assembled and glued, the jig also provides the facility for locating and applying the horizontal and diagonal cross bracing to one side of the bent. After the bent has been removed from the jig, the first set of cross-bracing can be used as a guide and reference for proper location of the adjacent bracing on the opposite side of the bent.

The jig is preferably built of molded plastic construction but may come in any sturdy material that will support the timbers that are needed. Wood, metal and other materials are some that come readily to mind.

The jigs of the present invention may be manufactured for each of the following popular model railroad scales: G, O, On3, S, Sn3, HO, and N. Variations of the jig in each of the aforementioned scales could be made available to model heavy or light load capacity bridges, as well, depending on the prototype railroad the hobbyist was attempting to model.

The indexing jig allows for custom designs of trestles. Scale lumber is readily available from several manufacturers which enables the modeler to use the jig to easily and accurately build bridges to his own specifications. The hole 6 near the top edge 7 of the jig may be used to hang the jig when not in use.

I claim:

1. An indexing jig for holding timber members for use in constructing a railroad bridge trestle made of timber members including: vertical members and horizontal cross members, a cap member, a mudsill member and cross bracing, said apparatus comprising: base of trapezoidal shape having upper edge corresponding to said cap member and a lower edge about parallel to said upper edge and of longer length than said upper edge, said base having left and right side edges, said base having a series of straight grooves forming a gridwork of grooves, said grooves holding said timber members for constructing said trestle, said grooves including a vertical groove at about the centerline of said indexing member and lying in a direction substantially perpendicular to said upper and lower edges, at least one secondary groove being located on each side of said vertical groove at an angle slightly away from parallel to said vertical groove so that said secondary members converse slightly as the approach said upper edge, at least one tertiary groove between each of said secondary grooves and said side edges, said tertiary grooves at an angle slightly away from parallel to said secondary grooves so that said tertiary members converge slightly as they approach said upper edge; said indexing member having horizontal grooves substantially perpendicular to said vertical groove and including upper horizontal groove near said upper edge of said base and a lower horizontal groove near said lower edge of said base.

2. The apparatus of claim 1 where each of said secondary grooves are about 3.75° from perpendicular to said upper edge and each of said tertiary grooves are about 7.5° from perpendicular to said upper edge.

3. An apparatus of claim 2 where said vertical groove is about 10" long and about 3/16" in width.

4. An apparatus of claim 3 where said upper horizontal groove is about 2⅛" in width.

5. An apparatus of claim 4 having an aperture located between said upper edge and said upper horizontal groove.

* * * * *